US006883951B2

(12) United States Patent
Wu

(10) Patent No.: US 6,883,951 B2
(45) Date of Patent: Apr. 26, 2005

(54) COMBINATIVE DECORATIVE LIGHT EQUIPMENT

(76) Inventor: Jeng-shyong Wu, No. 14, Alley 1, Lane 326, Shin-Pin Road, Hsinchu (TW)

( * ) Notice: Subject to any disclaimer, the term of this patent is extended or adjusted under 35 U.S.C. 154(b) by 0 days.

(21) Appl. No.: 10/353,764

(22) Filed: Jan. 29, 2003

(65) Prior Publication Data

US 2004/0145916 A1 Jul. 29, 2004

(51) Int. Cl.[7] ..... F21W 121/04

(52) U.S. Cl. ..... 362/565; 362/567; 362/568; 362/123; 362/252; 362/806; 362/226

(58) Field of Search ..... 362/123, 252, 362/806, 226, 225, 565, 567, 568

(56) References Cited

U.S. PATENT DOCUMENTS 3,970,834 A * 7/1976 Smith ..... 362/123
5,683,172 A * 11/1997 Huag ..... 362/252
5,702,170 A * 12/1997 Broderick ..... 362/568
5,776,559 A * 7/1998 Woolford ..... 428/18

* cited by examiner

*Primary Examiner*—Stephen Husar
*Assistant Examiner*—Anabel Ton
(74) *Attorney, Agent, or Firm*—McGlew and Tuttle, P.C.

(57) ABSTRACT

Disclosed is a combinative decorative light equipment wherein a plurality of lighting elements are mutually connected into several individual lamp groups by wires in series or series-parallel manner, so as to be hung on a structural framework. The upper connectors of said lamp groups are installed on the connecting device of different structural frameworks, and which are connected into a decoration framework, so that the lamp groups on different structural frameworks are mutually connected to form larger lamp groups and assembled into a pre-designed decoration body.

20 Claims, 3 Drawing Sheets

COMBINATIVE DECORATIVE LIGHT EQUIPMENT

BACKGROUND OF THE INVENTION

1. Field of the Invention

The present invention relates to a combinative decorative light equipment, and more particularly to a combinative decorative light equipment with lamp groups hung on individual structural frameworks. The connectors of lamp groups are installed on the connecting device of individual structural frameworks, so that the lamp groups are mutually connected to form larger lamp groups after a plurality of frameworks are assembled into a decoration framework.

2. Description of the Prior Art

Starry lamp series are frequently decorative articles in festival occasions, commercial advertisement, and special occasions for the effect of glittering like stars. A suitable amount of lamps is required for the lamp series to prevent them from being burned due to overloading, and to decorate with a decoration framework (e.g. artificial trees) so as to express the happy atmosphere of festivals fully. In early days, pre-assembled decoration frameworks were mostly used, with decorative lamps encircling the decoration frameworks so that it is not easy for the decorative lamps to be installed on top of the decoration frameworks. Moreover, it is not convenient to recycle the decorative lamps around the decoration frameworks when they are dissembled, thereby increasing the cost.

SUMMARY OF THE INVENTION

Accordingly, the present invention has been made to solve the aforesaid problem occuring in the prior art, and an object of the present invention is to provide a combinative decorative light equipment which has a plurality of lamp groups connected to each other with connectors, and is hung on the individual frameworks having connecting devices and controlled by a controller individually so as to achieve a dynamic sensitized decorative effect.

Another object of the present invention is to provide a combinative decorative light equipment wherein a plurality of lighting element connected by wires in series or series-parallel manner into several lamp groups of the same function so as to express the effect of glittering or constant lighting and enhance the bliss of celebration, this is the other object of the present invention.

According to the combinative decorative light equipment of the present invention, the structural framework call be in the tree shape, planer or three-dimensional to increase the variation of the appearance. This is another object of the present invention.

BRIEF DESCRIPTION OF THE DRAWINGS

The above and other object, features and advantages of the present invention will be more apparent from the following detailed description taken in conjunction with the accompanying draming, in which.

DETAILED DESCRIPTION OF THE PREFERRED EMBODIMENT

Figure 1:
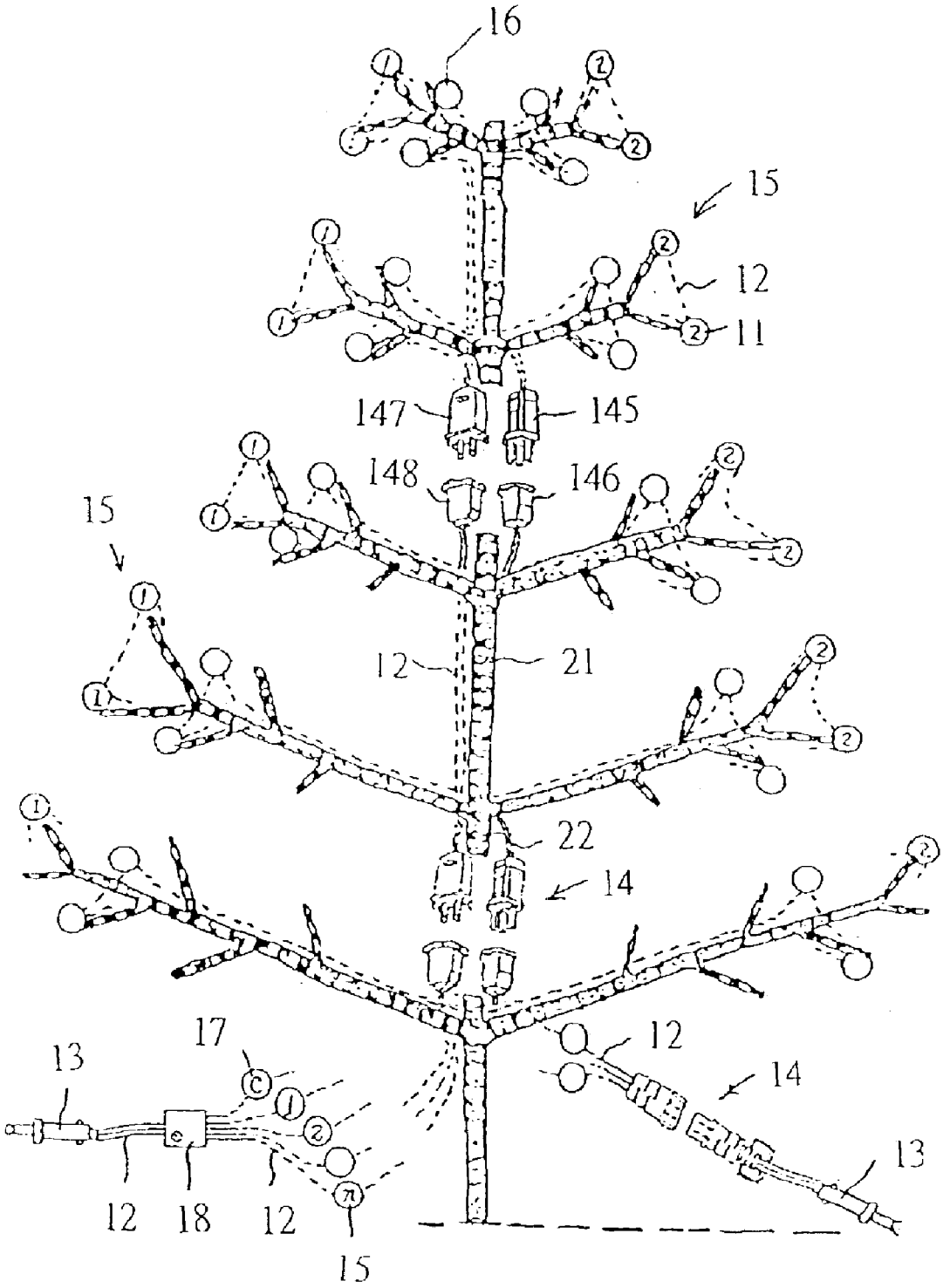
FIG. 1 is a perspective view showing the construction of the present invention.

As shown in FIG. 1, the combinative decorative lighting equipment of the present invention comprises a structural framework 21 and at least a lamp series 2, the framework 21 is configurated in a tree shape on which connectors 22 are installed with several wires 12 which are jointly connected to a functional controller 18. Then, the functional controller 18 is connected to a power supply connector 13 (such as a connector or a plug). The mentioned lamp series 2 is formed with a plurality of lighting elements 11 installed on suitable positions of the structural framework 21. Each of the lighting elements 11 formed of LEDs or tungsten lamps is mutually connected by wires 12 in series or series-parallel manner, and respectively connected into lamp groups 15, 16 of different appearance in different positions. Said lamp groups are respectively connected upwardly and downwardly to the functional controller 18. And Each circuits 17 is come out from the functional controller 18 respectively, and then is connected upwardly to a specific end socket 146 or a specific end socket 148, or downwardly to a specific socket 145 or another specific socket 147 as a lamp group connector 14 wherein said lamp group connector 145 is installed on the framework connecting device. Therefore, when the structural frameworks are connected into a decoration framework, it is easy to connect lamp groups 15, 16 with same connectors (specific end socket 146 can only be connected with a specific socket 145 whereas another end socket 148 can only be connected with a specific socket 147) into a larger lamp group to form a pre-designed decoration body, and the different ends of the used connectors are connected to the male and female ends of the connectors so as to fix the direction of the connection and acted as selective or restrictive connection. The larger lamp groups forming pre-designed a decoration body are specific lamp groups (commonly located at the lowest end of the lamp group), and a common power supply connector 13 is instead of the group lamp connector 14 in order to be connected with power source, and the power supply connector 13, wires 12 required, functional controller 18 and circuit 17 are jointly combined as the base of the lighting element, and the power supply connector 13 connected to household power source is connected to the functional controller 18 by the wire 12 to supply electricity to all the lamp groups through the circuit 17.

The lamp groups 15, 16 can be set that part of the group 16 is constantly turned on while part of the group 15 is alternatively glittering for controlling part of the lamp groups constantly turned on and others glittering to achieve a dynamic sensitized decorative effect.

In FIG. 1, if the used lighting elements are of the same type or specification, the connectors 14 are of the same type or specification, thereby to form a larger lamp group with mutually connecting; if the type or specification of the connector is different, the lighting elements cannot be connected with each other, thereby the amount of lamp groups 15, 16 in series or series-parallel manner are limited to restrict within the positions of the lamp groups or to form the pre-designed decoration body.

Figure 2:
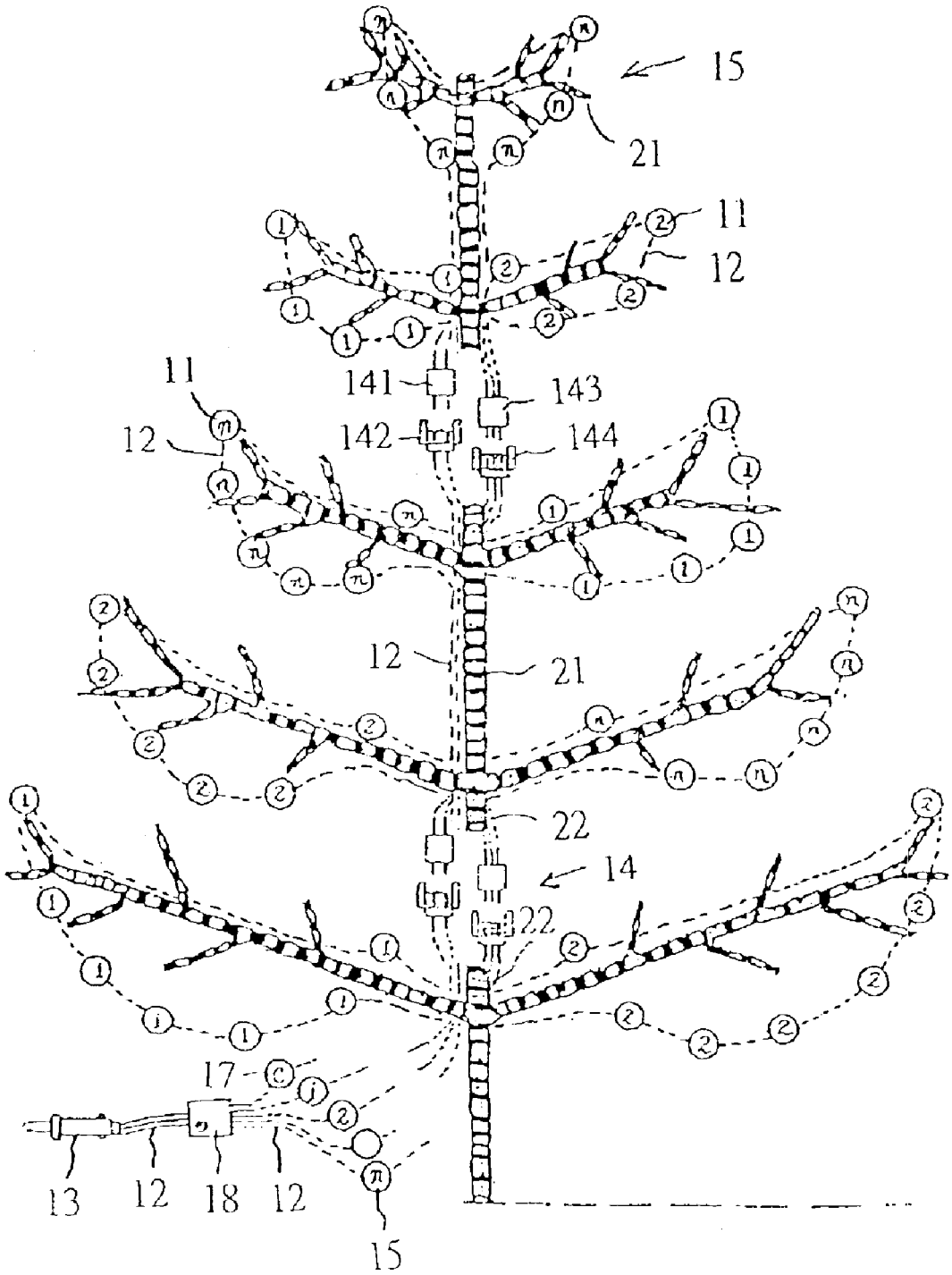
FIG. 2 is a plane view showing an embodiment of this invention.

As shown in FIG. 2 is another embodiment of a different decorative lamp connector. The lamp groups are upwardly and downwardly connected to a functional controller 18, and each circuit 17 is come out from the functional controller 18, then connected upwardly to a two-needle female pole 142 or a three-needle female pole 144, downwardly to a two-needle male pole 141 or another three-needle male pole 143 as a lamp group connector 14 positing on the connecting equipment of the structural framework. Therefore, when the frameworks are assembled into a decoration framework, it is easy to connect lamp groups 15 and 16 with the same connectors (a two-needle female pole 142 can only be connected with a two-needle male pole 141 whereas three-needle female pole 144 can only be connected with a three-needle male pole 143) into larger lamp groups to form a pre-designed decoration body, and different ends of the used connectors are connected to the male and female ends of the connectors so as to fix the direction of the connection and acted as selective or restrictive connection.

In FIG. 2, if the used lamp groups are assembled by lighting element of the same or different specification, the used connector 14 is of the same or different specification so that connectors of the same lamp groups can be mutually connected into larger lamp groups; if connectors are of different specification, then they cannot be connected to form a pre-designed decoration body.

Figure 3:
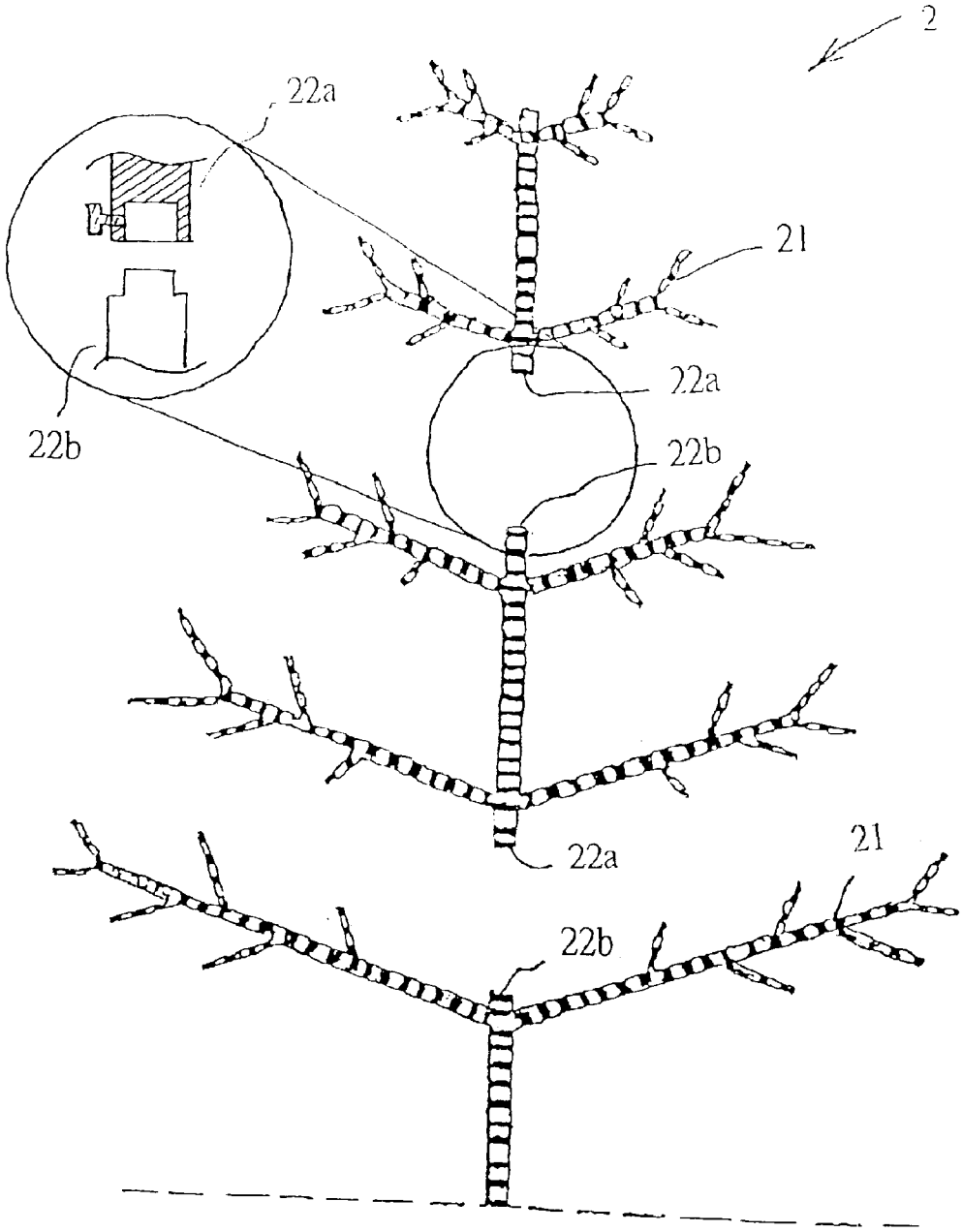
FIG. 3 is a plane view showing another embodiment of this invention.

FIG. 3 is the illustration of the combination of the decoration frameworks, wherein the used decoration frameworks are in the tree shape and can be planer or three-dimensional; as shown in the drawing, the upper and the lower ends of different structural frameworks 21 are installed with the connector 22, and the lower connector 22*a* of a framework and the connector 22*b* of another framework are connected with each other to form a decoration framework.

Although the present invention has been described using specified embodiment, the examples are meant to be illustrative and not restrictive. It is clear that many other variations would be possible without departing from the basic approach, demonstrated in the present invention.

What is claimed is:

1. A combinative decorative equipment comprising:

a lamp series: formed of a plurality of lamp groups with a plurality of lighting elements mutually connected in series or series-parallel manner by wires and lamp group connecting devices with each connecting device having connectors, and with the ends of the lamp groups connected to power connector;

a decorative article comprising: a pre-configuratad decoration framework formed of a plurality of frameworks, each of said frameworks having structural connecting devices with a structural male connector of one framework connecting with a structural female connector of another framework for structurally connecting one with another of said frameworks;

wherein said lamp groups are installed on the structural frameworks with no electrical wire contained in the structural frameworks and with the connectors on the connecting devices of the lamp groups to form a decoration framework, the connectors of the lamp groups being mutually connected to form larger lamp groups as pre-designed decoration body with connectors of said lamp groups not being contained in said frameworks and providing an electrical connection independent and separate from said structural male connector and structural female connector.

2. The combinative decorative light equipment as claimed in claim 1, wherein the used lighting elements are made of tungsten lamp or LEDs.

3. The combinative decorative light equipment as claimed in claim 1, wherein the used lighting elements are provided with lamp bases.

4. The combinative decorative light equipment as claimed in claim 1, wherein the used lamp groups are lighting elements of the same type or specification.

5. The combinative decorative light equipment as claimed in claim 4, wherein the used lamp connectors are of the same type or specification.

6. The combinative decorative light equipment as claimed in claim 4, wherein the used lamp group connectors are of different types and only those of same type can be mutually connected so as to limit the amount of lamp groups connected in series or in series-parallel manner, and to restrict the spreading positions of the lamp groups or to form a pro-designed decoration body.

7. The combinative decorative light equipment as claimed in claim 1, wherein the used lamp groups are assembled by lighting elements of different types.

8. The combinative decorative light equipment as claimed in claim 7, wherein the used lamp group connectors are of different types so that the lighting elements of different types cannot be mutually connected.

9. The combinative decorative light equipment as claimed in claim 1, wherein the used multiple lamp groups include a plurality of lighting element groups of the same type and a plurality of lighting element groups of different types.

10. The combinative decorative light equipment as claimed in claim 9, wherein the used lamp group connectors inchide a plurality of lighting element groups of the same type and a plurality of lighting element groups of different types, so that lighting element groups of same type and of different types can be connected mutually to achieve the pre-designed decoration body.

11. The combinative decorative light equipment as claimed in claim 1, wherein the used lamp group connectors are common power supply connectors pro-configured at one end of specific lamp groups so as to connect to a household power supply.

12. The combinative decorative light equipment as claimed in claim 11, wherein a common power supply connectors are used to connect with a functional controller, so that the controllers supply electricity to the lamp groups to achieve the pre-designed glittering effect.

13. The combinative decorative light equipment as claimed in claim 1, wherein the used lamp group connectors are connected to the male plug and female socket of the connectors so as to fix the direction, and acted as selective or restrictive connection.

14. The combinative decorative light equipment as claimed in claim 1, wherein the used lamp groups have the coexisting functions of constantly lighting and glittering to achieve the pre-designed decorative lamp group.

15. The combinative decorative light equipment as claimed in claim 1, wherein the used decoration frameworks are in the free shape and can be planar or three-dimensional.

16. A decorative lighting arrangement comprising:

a decorative article including a plurality of decorative structural portions, each of said decorative structural portions having structural connectors for connecting to other said decorative structural portions and together forming said decorative article;

a plurality of lamp groups arranged on said decorative structural portions, each of said lamp groups including a plurality of lighting elements electrically connected to each other, said each lamp group including an electrical lamp connector for supplying electricity to a respective said lamp group, each said electrical lamp connector being arranged at one of said structural connector; and a functional controller having a plurality of circuits, each of said circuits having an electrical controller connector for connecting to one of said electrical lamp connectors.

17. An arrangement in accordance with claim 16, wherein:

said functional controller applies different electrical signals to different said lamp groups.

18. An arrangement in accordance with claim 17, wherein:

each of said electrical controller connectors being formed to only connect to one of said electrical lamp connectors, each of said electrical controller connectors connecting to a different one of said electrical lamp connectors.

19. An arrangement in accordance with claim 18, wherein:

said decorative structural portions are connected together in series to form said decorative article, said functional controller being arranged at one end of said decorative article, said circuits of said functional controller and respective said lamp groups extending from said one end of said decorative article and along said plurality of decorative structural portions to another end of said decorative article.

20. The combinative decorative light equipment as claimed in claim 1, wherein said connector on the connecting devices of the lamp groups are one of male and female connectors with said connectors being coordinated with said structural male connector and structural female connector with said connectors on the connecting devices of the lamp groups having one of male and female connectors on said frame work adjacent to said structural male connector and the other of said one of male and female connectors at said structural female connector.

* * * * *